US006609736B2

(12) United States Patent
Yeh

(10) Patent No.: US 6,609,736 B2
(45) Date of Patent: Aug. 26, 2003

(54) HORIZONTAL MOTOR-DRIVEN LOCK

(75) Inventor: Tsun-Tsai Yeh, Hsinchu (TW)

(73) Assignee: Kinyo Co., Ltd., Hsinchu (TW)

( * ) Notice: Subject to any disclaimer, the term of this patent is extended or adjusted under 35 U.S.C. 154(b) by 0 days.

(21) Appl. No.: 10/107,835

(22) Filed: Mar. 26, 2002

(65) Prior Publication Data

US 2003/0071470 A1 Apr. 17, 2003

(51) Int. Cl.[7] ..... E05C 1/06

(52) U.S. Cl. ..... 292/144; 292/336.3; 292/201; 292/216; 70/277; 70/279.1; 74/625; 74/84 R

(58) Field of Search ..... 292/336.3, 144, 292/201, 216, 244; 70/278.7, 280, 282, 283, 277, 279.1; 74/512, 560, 22 R, 22 A, 27, 52, 84 R, 625; 254/98, 97

(56) References Cited

U.S. PATENT DOCUMENTS 5,857,365 A * 1/1999 Armstrong ..... 70/279.1
6,032,991 A * 3/2000 Yeh ..... 292/336.3
6,062,612 A * 5/2000 Lin ..... 292/144
6,119,538 A * 9/2000 Chang ..... 74/89.33
6,334,636 B1 * 1/2002 Huang et al. ..... 292/144
6,418,765 B1 * 7/2002 Chiu ..... 70/279.1
6,471,257 B1 * 10/2002 Lu et al. ..... 292/144

* cited by examiner

*Primary Examiner*—Robert J. Sandy
*Assistant Examiner*—Matthew E. Rodgers
(74) *Attorney, Agent, or Firm*—Wei Te Chung

(57) ABSTRACT

A motor-driven lock (2) includes a housing (3), a lock body (4), a motor (5), a transmission device (6) mating with the motor and the lock body, a lid (7), an enclosure (8), and a cover (9). The lock body includes a controller (41) having a gear portion (410), and a cap (43) attached to the controller. The transmission device includes a first gearshaft (60) mating with the motor, a second shaft (61) meshed with the first gearshaft, a wheel (62) meshed with the second gear shaft, a screw shaft (63) fixing the wheel thereon, a slider (64) mating with the screw shaft, a yoke (65) slidingly movable along the housing and actuatable by the slider, and a gear set (66) attached to the cap of the lock body, meshed with the gear portion of the lock body and mated with either of two racks (653) of yoke.

26 Claims, 9 Drawing Sheets

2

HORIZONTAL MOTOR-DRIVEN LOCK

BACKGROUND OF THE INVENTION

1. Field of the Invention

The present invention relates to a motor-driven lock, and particularly to a horizontal motor-driven lock having a simple transmission device. The instant invention relates to a copending application filed on Mar. 26, 2002, with an unknown serial number and the same applicant, titled as "MOTOR-DRIVEN LOCK".

2. Prior Art

FIG. 1 shows an exploded view of a conventional lock 20 for a door in a building. The lock 20 includes an external controller 34, a latch subassembly (not shown), and an internal controller 22. An inside shaft 30 and an outside shaft 32 receiving the inside shaft 30 extend through the latch subassembly, and connect the external controller 34 and the internal controller 22. The latch subassembly is received in an opening (not shown) defined in a door (not shown), and projects sidewardly to be received in a recess (not shown) defined in a frame (not shown) of the door. The external controller 34 located at the outside of the door defines a first axial hole (not shown), for receiving the outside and inside shafts 30, 32. The internal controller 22 locating at the inside of the door defines a second axial hole 220, for receiving the outside and inside shafts 30, 32.

The internal controller 22 includes a manual switch 221 connecting the inside shaft 30, and a control shaft 222 connecting the outside shaft 32. The manual switch 221 is rotatable to rotate the inside shaft 30 to actuate a pin (not shown). The pin engages with or disengages from the outside shaft 32, thereby locking or unlocking the lock 20. Thus, the manual switch 221 controls the lock 20 being locked or unlocked via the inside shaft 30 controlling the outside shaft 32. The internal controller 22 rotates the control shaft 222 to control the outside shaft 32 to unlock the lock 20. A key (not shown) is receivable in the external controller 34, to control the outside shaft 32 to unlock the lock 20.

However, using a key to unlock a door lock can be inconvenient, particularly at night or when one's hands are not free. A motor-driven lock can be more convenient. Even then, transmission devices of conventional motor-driven locks are complicated. Furthermore, a conventional lock is configured such that it can only be fitted to a left side or a right side of a door. Thus two configurations of a conventional lock are needed to meet the differing requirements of all kinds of doors. This unduly inflates costs. U.S. Pat. Nos. 3,767,240, 4,438,962, 4,483,162, 5,790,034, 5,857,365, 5,979,199, 6,012,310 and 6,032,991 disclose some examples.

SUMMARY OF THE INVENTION

Accordingly, an object of the present invention is to provide a motor-driven lock having a simple transmission device for easy manufacturing and reduced costs.

Another object of the present invention is to provide a motor-driven lock having a transmission device that allows the lock to be fitted to a left side or a right side of a door.

To achieve the above-mentioned objects, a motor-driven lock of the present invention includes a housing defining a central hole, a lock body extending through the central hole of the housing and attached to the housing, a motor received in the housing and having a motor gear, a transmission device received in the housing and mating with the motor and the lock body, a lid attached to the housing over the transmission device, an enclosure attached to one side of the housing, and a cover attached to another side of the housing. The lock body includes a controller having a gear portion, a cap attached to the controller, and a handle extending through the cap and attached to the controller. The transmission device includes a first gearshaft meshed with the motor gear of the motor, a second gearshaft meshed with the first gearshaft, a wheel meshed with the second gearshaft, a screw shaft fixing the wheel thereon, a slider mating with the screw shaft, a yoke slidingly movable along the housing and actuatable by the slider, and a gear set. The gear set is attached to the cap of the lock body, meshed with the gear portion of the lock body, and mated with either of two racks of the yoke.

Other objects, advantages and novel features of the present invention will be drawn from the following detailed description of a preferred embodiment of the present invention with attached drawings, in which:

DETAILED DESCRIPTION OF THE PREFERRED EMBODIMENT

Figure 1:
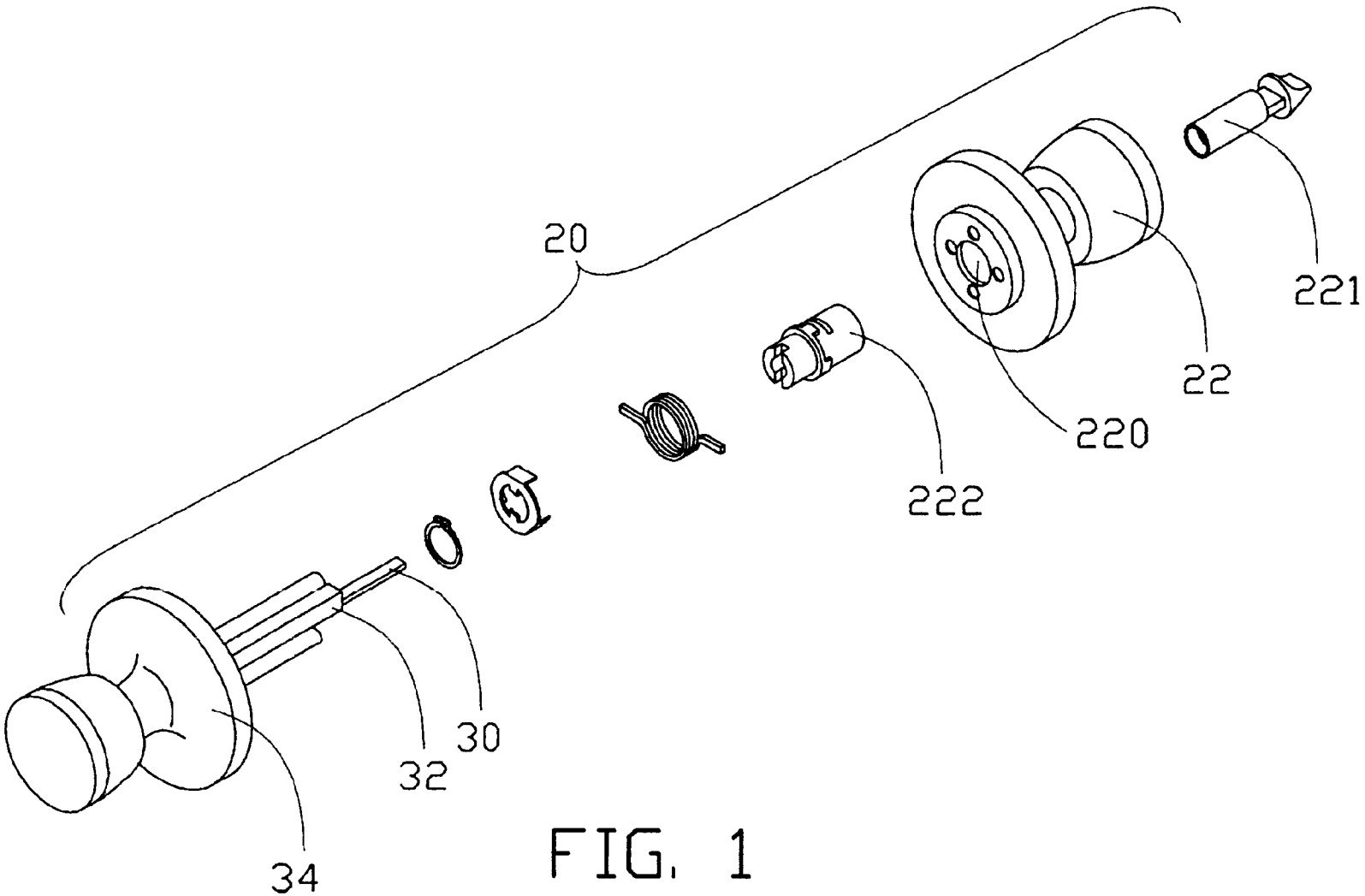
FIG. 1 (PRIOR ART)
FIG. 1 is an exploded perspective view of a conventional lock.
Figure 2:
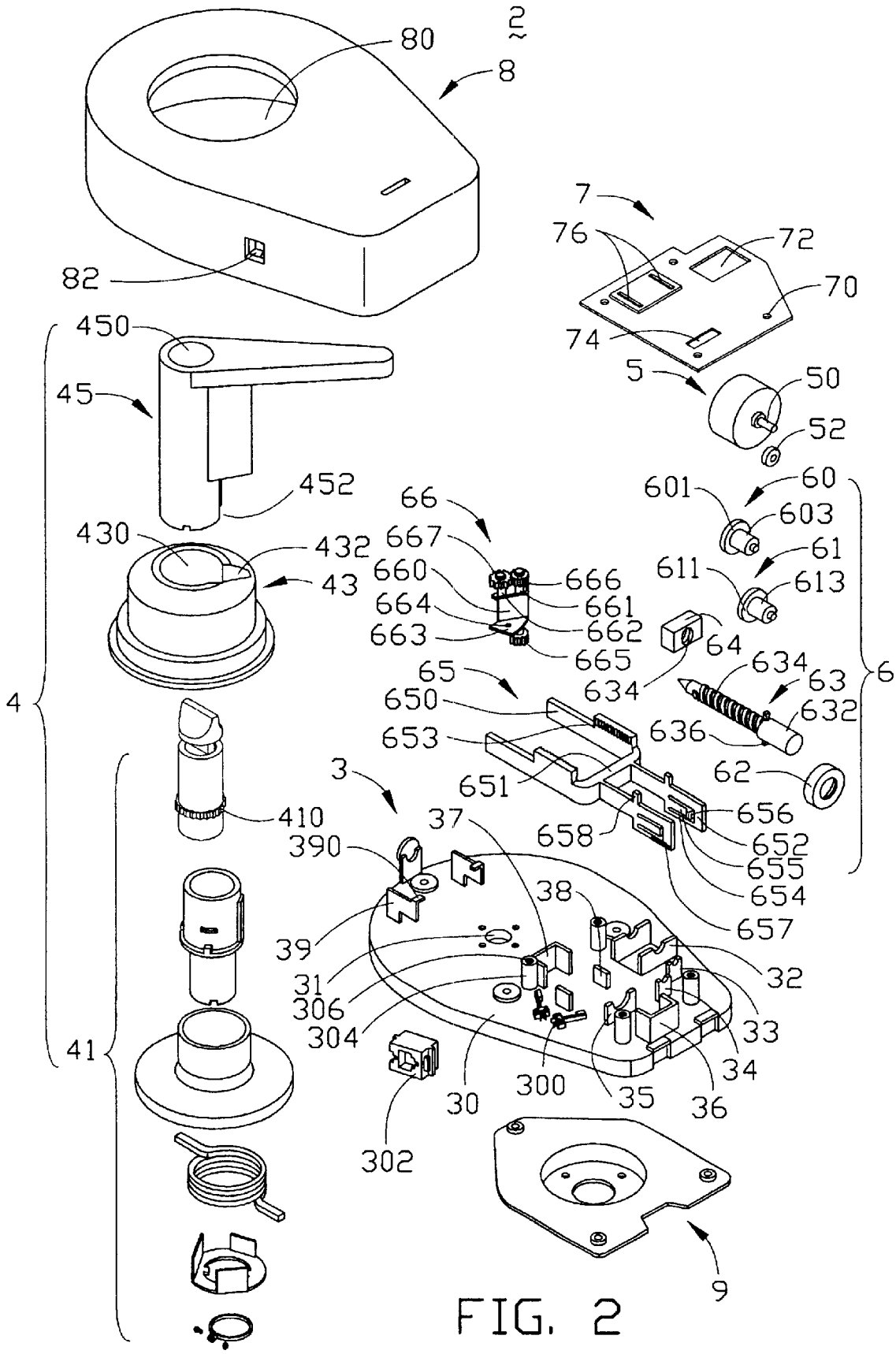
FIG. 2 is an exploded perspective view of a motor-driven lock in accordance with the present invention.
Figure 3:
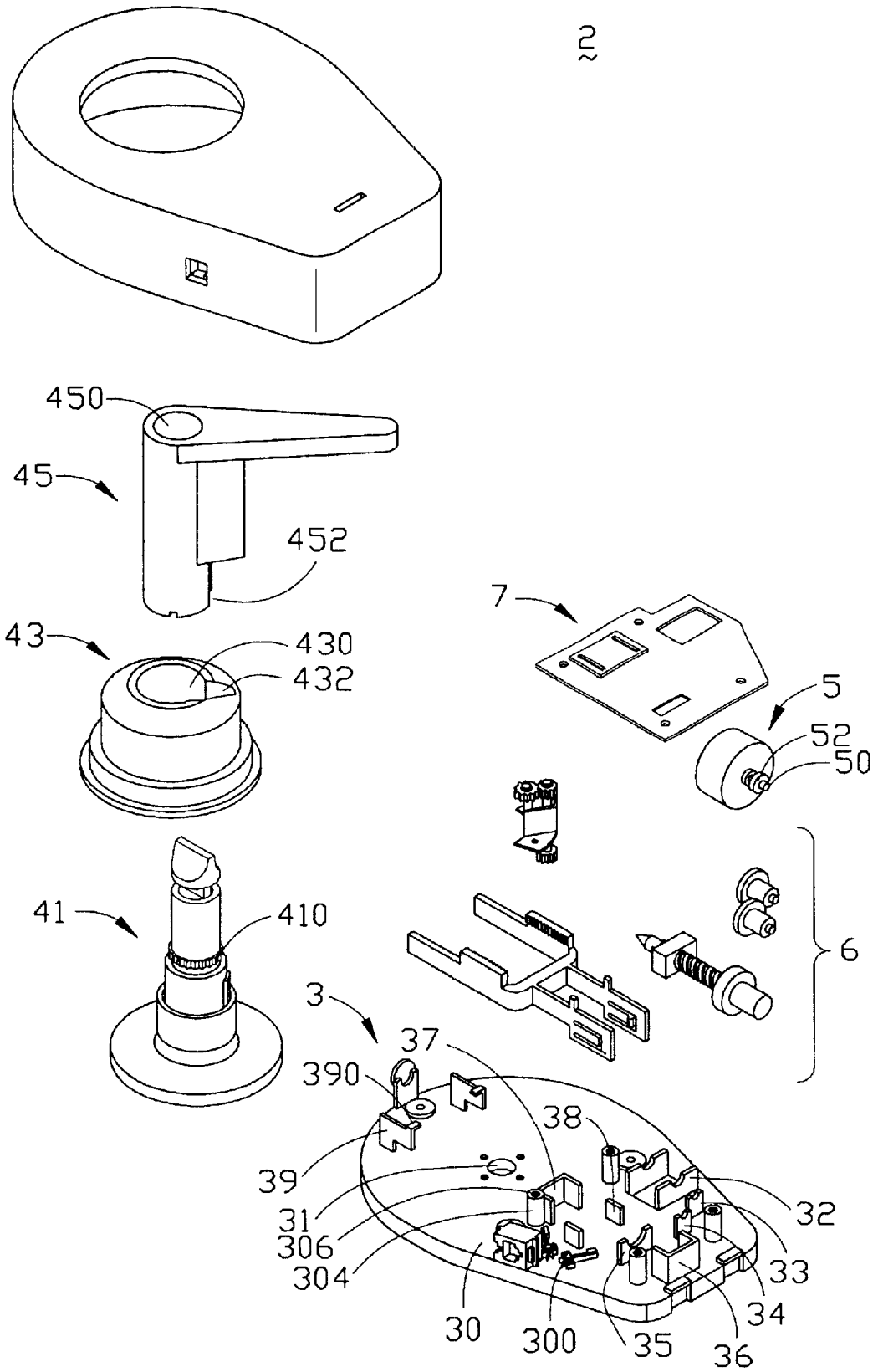
FIGS. 3–6 are similar to FIG. 2, but showing progressive stages of assembly of the lock of the present invention.

Referring to FIGS. 2 and 3, a horizontal motor-driven lock 2 in accordance with the present invention includes a housing 3, a lock body 4, a motor 5, a transmission device 6, a lid 7, a top enclosure 8 and a bottom cover 9. The housing 3 includes a base 30, in which a central hole 31 is defined for extension of the lock body 4 therethrough. A motor pedestal 32, a first gearshaft pedestal 33, a second gearshaft pedestal 34, a screw shaft pedestal 35 and a screw shaft seat 36 are formed adjacently on a top surface of the base 30. A stop 37 is formed opposite the screw shaft seat 36. A pair of position blocks 38 is formed generally between the screw shaft pedestal 35 and the stop 37. A pair of guiding blocks 39 extends upwardly from the base 30. Each guiding block 39 has a horizontal position tab 390 formed at a top portion thereof. Two sensor contacts 300 are formed on the base 30, at opposite sides respectively of one of the position blocks 38. A connector 302 is mounted on the base 30, for connecting with an outside electrical controller (not shown). Four fixing posts 304 extend upwardly from the base 30. The fixing posts 304 are positioned to form a generally rectangular array. Each fixing post 304 has a screw hole 306 defined therein.

The lock body 4 includes a controller 41, a cap 43, and a handle 45. An annular gear portion 410 is formed on the controller 41. A through hole 430 is defined in the cap 43, for extension of the controller 41 therethrough. A recess 432 is defined in the cap 43, in communication with the through hole 430. A through slot 450 is defined in the handle 45, for extension of the controller 41 therethrough. A cutout 452 is defined in the handle 45, in communication with the through slot 450.

The motor 5 has a rotatable shaft 50, and a gear 52 attached to the rotatable shaft 50 for output of rotation of the rotatable shaft 50. The transmission device 6 includes a first gearshaft 60, a second gearshaft 61, a wheel 62, a screw shaft 63, a slider 64, a yoke 65, and a gear set 66. The first and second gearshafts 60, 61 have large gear sections 601, 611 and small gear sections 603, 613, respectively. The screw shaft 63 has a head portion 632, and a screwthread portion 634 extending from the head portion 632. Two opposite position pins 636 extend from a junction of the head portion 632 and the screwthread portion 634, for abutting against the screw shaft pedestal 35. A screwthread hole 642 is defined in the slider 64, for threaded engagement with the screwthread portion 634 of the screw shaft 63.

Figure 7:
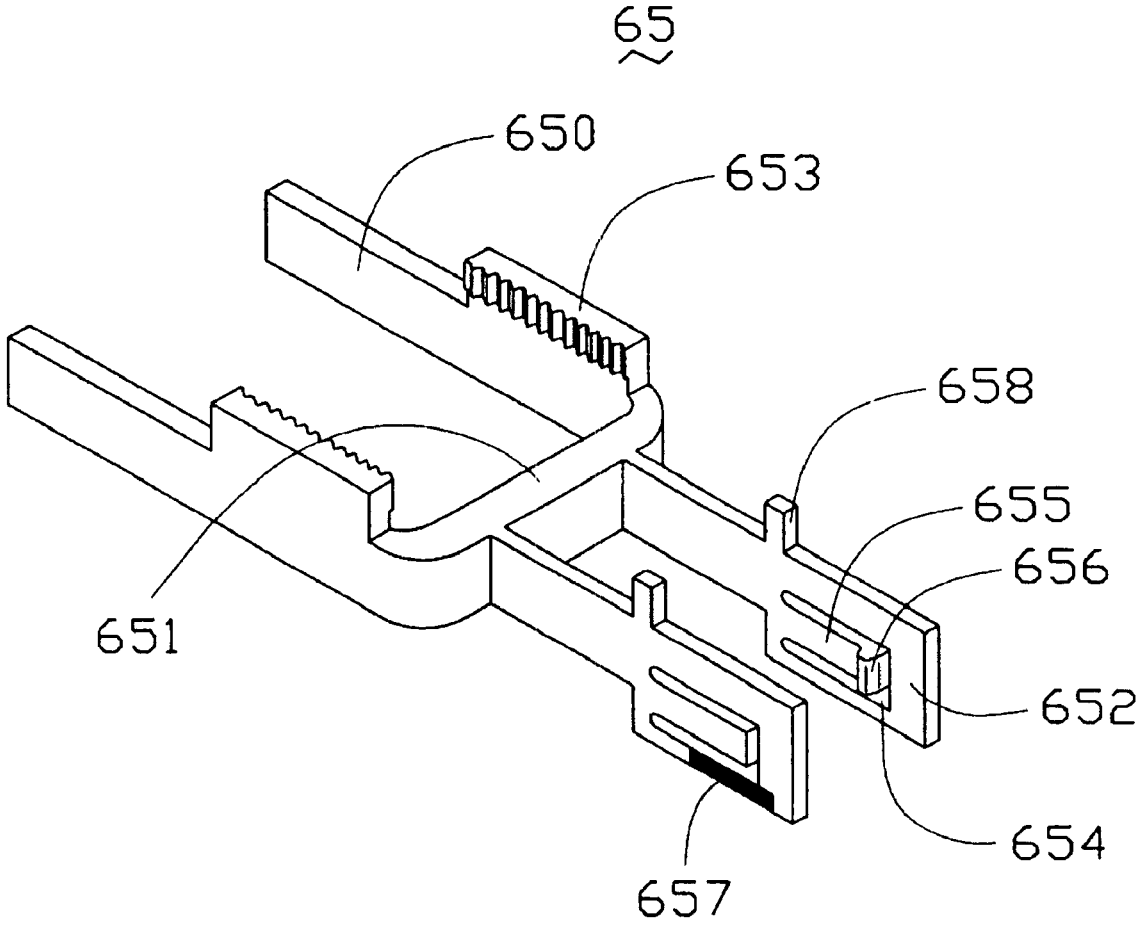
FIG. 7 is a perspective view of a yoke of a transmission device of the lock of the present invention.

Referring also to FIG. 7, the yoke 65 has two parallel leg portions 650, a central portion 651 connecting between the leg portions 650, and two parallel arm portions 652 extending from the central portion 651 away from the leg portions 650. A pair of horizontal racks 653 is upwardly formed from the leg portions 650 respectively, adjacent the central portion 651. A pair of U-shaped slits 654 is defined respectively in free ends of the arm portions 652, thereby forming a pair of resilient latches 655. Each latch 655 has an inward protrusion 656 at a free end thereof. A sensor 657 is attached to an outside surface of one arm portion 652 below the U-shaped slit 654. A pair of guiding pins 658 extends upwardly from central sections of top edges of the arm portions 652 respectively.

The gear set 66 is received in the recess 432 of the cap 43. The gear set 66 has a bracket 660, and parallel first and second spindles 661, 662 rotatably attached in the bracket 660. First and second gears 665, 666 are attached respectively to bottom and top ends of the first spindle 661. A third gear 667 is attached to a top end of the second spindle 662. The third gear 667 is meshed with the second gear 666. A fixing plate 663 extends perpendicularly from a bottom edge of the bracket 660. A fixing hole 664 is defined in the fixing plate 663, for fixing the gear set 66 to the cap 43.

The lid 7 has a generally arch-shaped profile. Four fixing apertures 70 are respectively defined at four corners of the lid 7, corresponding to the fixing posts 304 of the housing 3. A rectangular hole 72 is defined near one of the corners of the lid 7, corresponding to the motor pedestal 32 of the housing 3. A rectangular slot 74 is defined at a corner of the lid 7 that is diagonally opposite from the rectangular hole 72. The rectangular slot 74 corresponds to a space between the screw shaft pedestal 35 and the screw shaft seat 36 of the housing 3. Two parallel splits 76 are defined in the lid 7, in the vicinity of one of the corners of the lid 7 that is between the rectangular hole 72 and the rectangular slot 74.

An opening 80 is defined in a top surface of the top enclosure 8, for extension of the lock body 4 therethrough. A connecting port 82 is defined in a side wall of the top enclosure 8, corresponding to the connector 302 of the housing 3. The bottom cover 9 is attached to a bottom surface of the housing 3.

Figure 4:
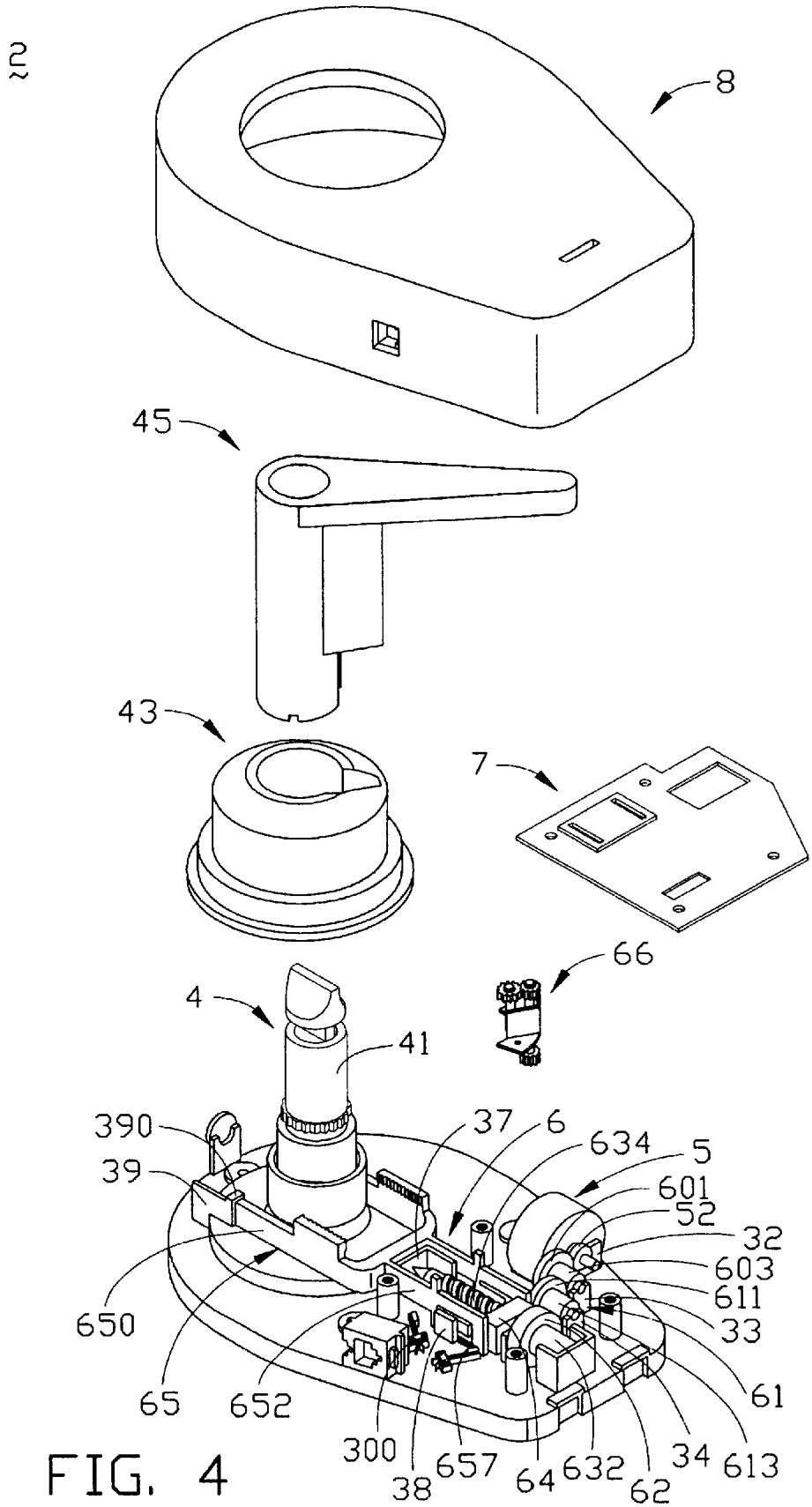

FIGS. 3–6 show progressive stages of assembly of the lock 2. Referring to FIG. 4, the controller 41 is mounted on the housing 3 over the central hole 31. The motor 5 is received on the motor pedestal 32 of the housing 3. The first and second gearshafts 60, 61 of the transmission device 6 are received on the first and second gearshaft pedestals 33, 34 of the housing 3. The large gear portion 601 of the first gearshaft 60 meshes with the gear 52 of the motor 5. The small gear portion 603 of the first gearshaft 60 meshes with the large gear portion 611 of the second gearshaft 61. The wheel 62 is fixed to the head portion 632 of the screw shaft 63. The slider 64 is threadedly attached to the screw shaft 63. The screw shaft pedestal 35 and the screw shaft seat 36 cooperate to rotatably receive the screw shaft 63. The head portion 632 of the screw shaft 63 is received between the screw shaft pedestal 35 and the screw shaft seat 36. The wheel 62 meshes with the small gear portion 613 of the second gearshaft 61. The slider 64 is movable between the stop 37 and the screw shaft pedestal 35. The arm portions 652 of the yoke 65 are slidably received between the position blocks 38. The resilient latches 655 of the arm portions 652 respectively abut the position blocks 38. The yoke 65 is slidingly movable along the housing 3. Accordingly, the sensor 657 of the yoke 65 can slidingly contact each of the sensor contacts 300 of the housing 3. The connector 302 is mounted at an edge of the housing 3 near the sensor contacts 300. The leg portions 650 of the yoke 65 are slidably received between the guiding blocks 39 of the housing 3 such that they respectively abut the guiding blocks 39. The position tabs 390 of the guiding blocks 39 slidably abut and retain top edges of the leg portions 650 respectively. Bottom edges of the leg portions 650 slidably abut the controller 41. The gear set 66 is received in the recess 432 of the cap 43. A bolt (not shown) is extended through the fixing hole 664 of the gear set 66 and threadedly engaged with the cap 43.

Figure 5:
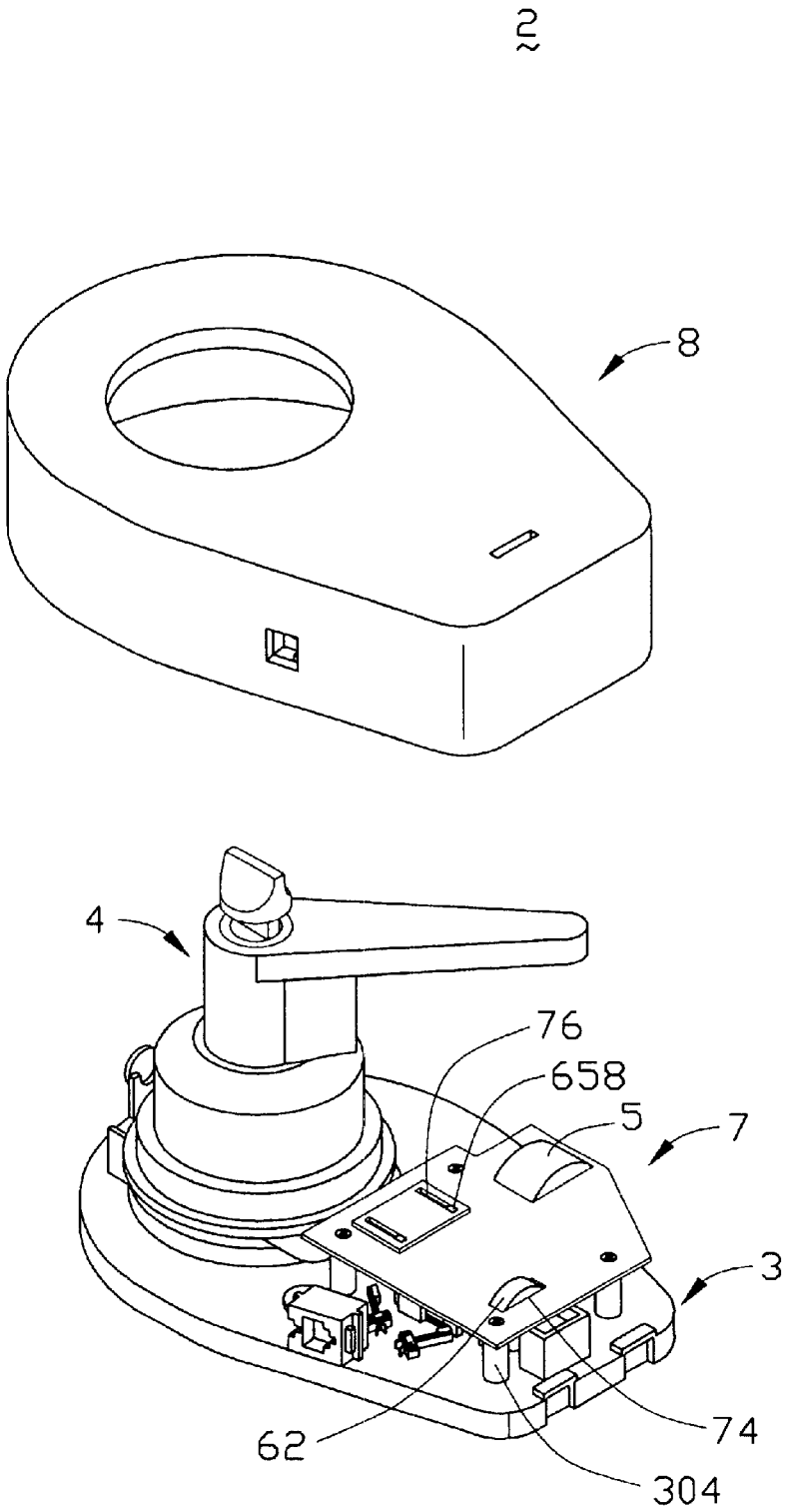
Figure 6:
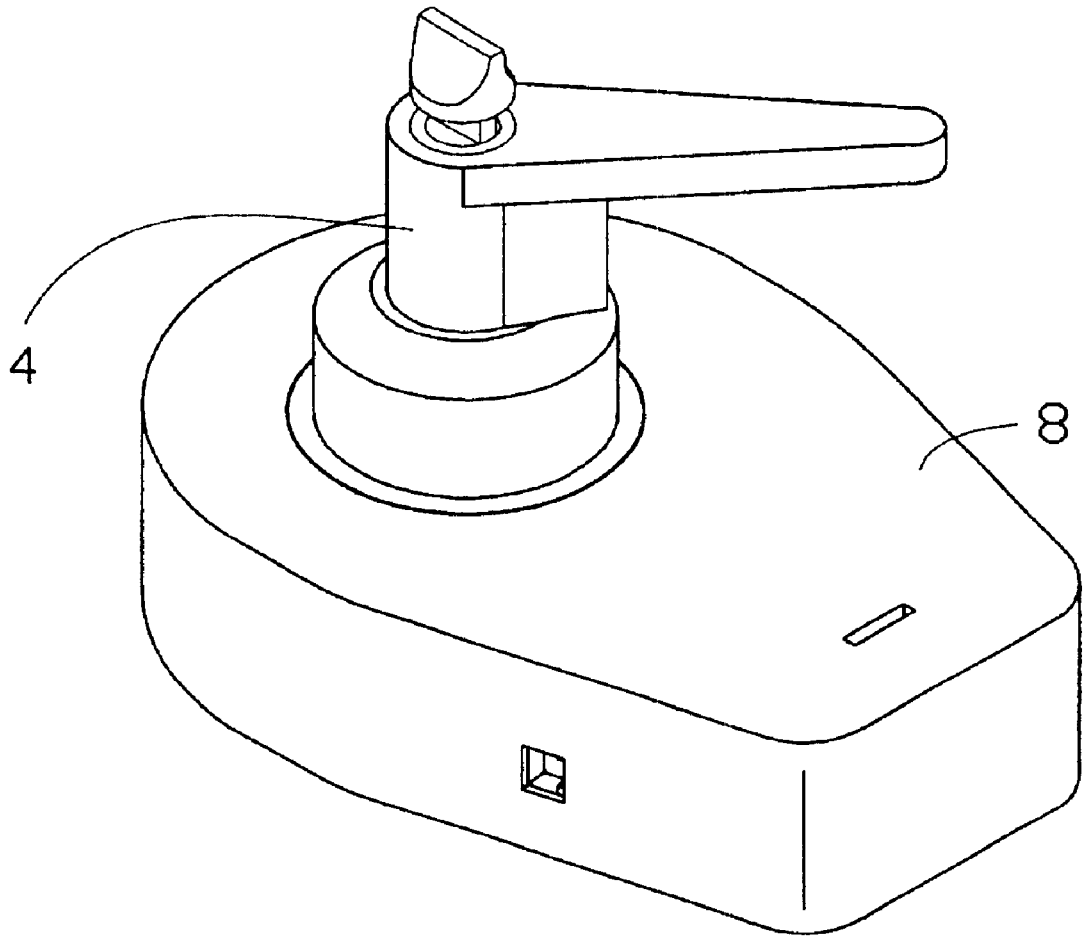
Figure 8:
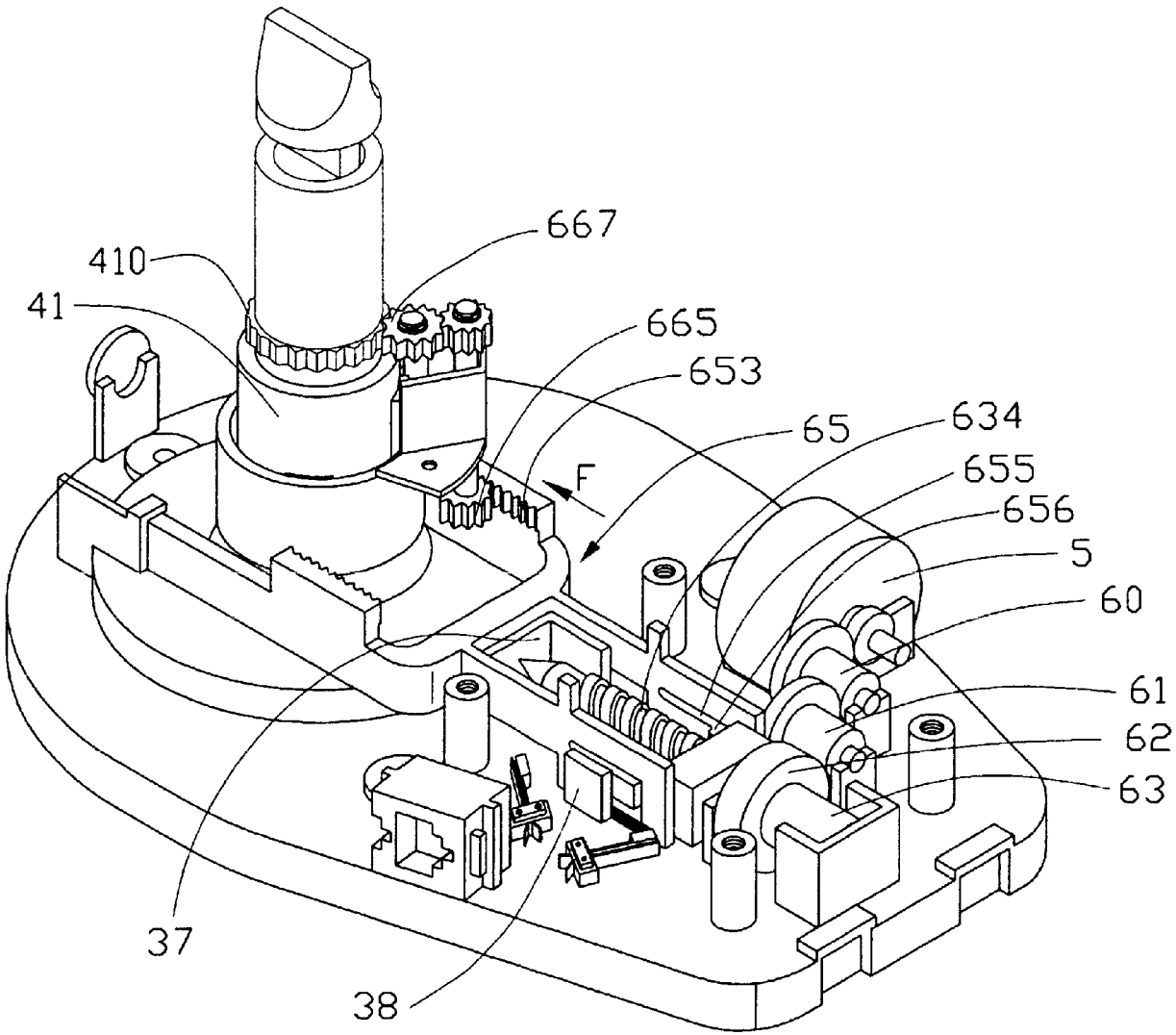
FIG. 8 is a perspective view of a motor, a transmission device and a controller of the lock of the present invention, showing operation when the lock is opened.

Referring to FIGS. 5, 6 and 8, the combined cap 43 and gear set 66 is attached to the controller 41. The first gear 665 of the gear set 66 meshes with one of the racks 653 of the yoke 65. The third gear 667 of the gear set 66 meshes with the gear portion 410 of the controller 41. The handle 45 is attached to the controller 41. The gear portion 410 of the controller 41 is exposed at the cutout 452 of the handle 45. The lid 7 is attached to the housing 3 over the transmission device 6. Four bolts (not labeled) are extended through the fixing apertures 70 of the lid 7 and threadedly engaged in the screw holes 306 of the fixing posts 304 of the housing 3. The motor 5 projects through the rectangular hole 72 of the lid 7. The wheel 62 projects through the rectangular slot 74 of the lid 7. The guiding pins 658 of the yoke 65 are slidably received in the splits 76 of the lid 7 respectively. The top enclosure 8 is attached on the housing 3, with the connecting port 82 of the top enclosure 8 aligning with the connector 302 of the housing 3.

Figure 9:
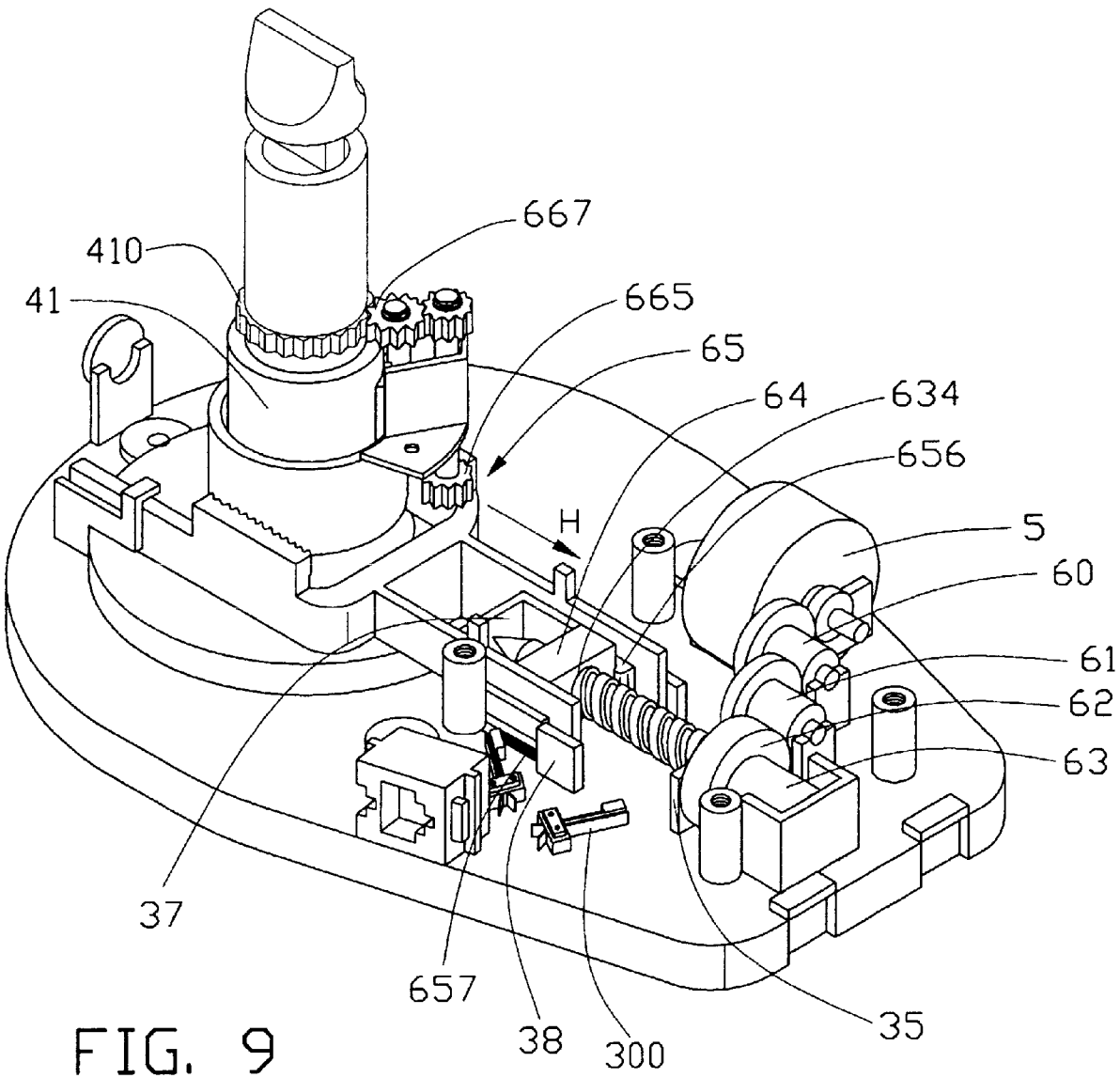
FIG. 9 is similar to FIG. 8, but showing operation when the lock is closed.

Referring to FIGS. 8 and 9, in operation, the motor 5 rotates the screw shaft 63 through the first and second gearshafts 60, 61 and the wheel 62. The first and second gearshafts 60, 61 and the wheel 62 cooperatively function as a retarder, so that the screw shaft 63 rotates at a lower speed than a speed of rotation of the motor 5. When the screw shaft 63 rotates, the screwthread portion 634 of the screw shaft 63 in the screwthread hole 642 of the slider 64 actuates the slider 64 to move away from or toward the head portion 632 of the screw shaft 63.

When the slider 64 moves along direction F, the slider 64 actuates the protrusions 656 of the resilient latches 655. The resilient latches 655 abut against the position blocks 38, and the yoke 65 is moved along direction F. The sensor 657 of the yoke 65 is in electrical contact with one of the sensor contacts 300 that is nearer the head portion 632. Thus, the said one of the racks 653 actuates the gear set 66 and the gear portion 410 to rotate the controller 41 and open the lock 2. When the resilient latches 655 have moved to positions free from the position blocks 38, the yoke 65 is stopped. However, the slider 64 is still going ahead, so the slider 64 actuates the protrusions 656 with a quite large force to resiliently deform the resilient latches 655 outwardly. Thus, the slider 64 continues moving, with opposite side surfaces (not labeled) thereof riding over the protrusions 656 of the latches 655. The sensor 657 moves free from the sensor contact 300 that is nearer the head portion 632, and moves into electrical contact with the other sensor contact 300. The motor 5 is turned off by the sensor contacts 300. However, due to inertia, the rotatable shaft 50 of the motor 5 continues to rotate to move the slider 64. Finally, the slider 64 is stopped by the stop 37. The resilient latches 655 resiliently return to their original orientations, and secure the slider 64 therebetween.

When the slider 64 moves along direction H, the yoke 65 is free to move along direction H and so the slider 64 actuates the protrusions 656 of the resilient latches 655 to move the yoke 65 along direction H. The resilient latches 655 then abut against the position blocks 38. The sensor 657 of the yoke 65 is in electrical contact with the sensor contact 300 that is further from the head portion 632. Thus, the said one of the racks 653 actuates the gear set 66 and the gear portion 410 to rotate the controller 41 and close the lock 2. When the resilient latches 655 have moved to positions free from the position blocks 38, the yoke 65 is stopped. However, the slider 64 is still going ahead, so the slider 64 actuates the protrusions 656 with a quite large force to resiliently deform the resilient latches 655 outwardly. Thus, the slider 64 continues moving, with the opposite side surfaces (not labeled) thereof riding over the protrusions 656 of the latches 655. The sensor 657 moves free from the sensor contact 300 that is further from the head portion 632, and moves into electrical contact with the sensor contact 300 that is nearer the head portion 632. The motor 5 is turned off by the sensor contacts 300. However, due to inertia, the rotatable shaft 50 of the motor 5 continues to rotate to move the slider 64. Finally, the slider 64 is stopped by the screwshaft pedestal 35. The resilient latches 655 resiliently return to their original orientations, and secure the slider 64 therebetween.

The above-described operation is premised on the lock 2 being fixed on one side of a door (not shown). Accordingly, the said one of the racks 653 of the yoke 65 is operated. However, the lock 2 may equally be fixed on an opposite side of the door. In such case, the lock body 4 is rotated such that the first gear 665 of the gear set 66 meshes with the other of the racks 653 of the yoke 65. Accordingly, the other of the racks 653 of the yoke 65 is operated. Thus, the transmission device 6 enables the lock 2 to be fixed on either of opposite sides of a door.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A motor-driven lock comprising:

a housing;

a lock body attached to the housing, the lock body comprising a controller having a gear portion;

a motor; and a transmission device comprising a screw shaft, a slider mating with the screw shaft and a yoke actuatable by the slider for driving the gear portion of the lock body, wherein the screw shaft is capable of transmitting rotational movement of the motor to linear movement of the slider.

2. The motor-driven lock as claimed in claim 1, wherein when the motor rotates at a given speed, the transmission device functions as a retarder such that the gear portion of the lock body rotates at a desired speed lower than the given speed.

3. The motor-driven lock as claimed in claim 1, wherein the transmission device further comprises a first gearshaft mating with the motor, a second gearshaft mating with the first gearshaft, a wheel mating with the second gearshaft, the screw shaft fixedly engaging with the wheel, and a gear set mating with the yoke and the gear portion of the lock body.

4. The motor-driven lock as claimed in claim 3, wherein the housing comprises a first gearshaft pedestal receiving the first gearshaft therein, a second gearshaft pedestal receiving the second gearshaft therein, and a screw shaft pedestal for receiving the screw shaft therein.

5. The motor-driven lock as claimed in claim 4, wherein the housing further comprises a screw shaft seat cooperating with the screw shaft pedestal to receive the screw shaft thereon.

6. The motor-driven lock as claimed in claim 4, wherein the housing further comprises a stop for stopping movement of the slider of the transmission device.

7. The motor-driven lock as claimed in claim 3, wherein the yoke comprises a pair of leg portions, a central portion connecting between the leg portions, and a pair of arm portions extending from the central portion away from the leg portions, and wherein the housing comprises a pair of position blocks movably receiving the arm portions of the yoke therebetween, and a pair of guiding blocks movably receiving the leg portions of the yoke therebetween.

8. The motor-driven lock as claimed in claim 7, wherein each of the guiding blocks further comprises a position tab extending from a top portion thereof and slidably abutting a corresponding leg portion of the yoke.

9. The motor-driven lock as claimed in claim 7, wherein the yoke further comprises a pair of resilient latches respectively formed in the arm portions, each of the resilient latches has a protrusion inwardly extending from a free end thereof, and the slider is adapted to actuate the protrusions of the resilient latches to move the yoke.

10. The motor-driven lock as claimed in claim 7, wherein the yoke further comprises a pair of racks respective formed on the leg portions thereof, and either of the racks is mated with the gear set.

11. The motor-driven lock as claimed in claim 7, wherein the yoke further comprises a pair of guiding pins extending from top edges of the arm portions respectively, for guiding movement of the yoke.

12. The motor-driven lock as claimed in claim 7, wherein the yoke further comprises a sensor, and the housing further comprises a pair of sensor contacts positioned to alternately electrically contact the sensor.

13. The motor-driven lock as claimed in claim 3, wherein the gear set comprises a first spindle, a second spindle parallel to the first spindle, a first gear attached at one end of the first spindle, a second gear attached at an opposite end of the first spindle, and a third gear attached to the second spindle and mating with the second gear.

14. The motor-driven lock as claimed in claim 13, wherein the gear set further comprises a bracket rotatably attaching the first and second spindles thereat, and a fixing plate extending from the bracket, and wherein a fixing hole is defined in the fixing plate, the lock body further comprises a cap defining a recess receiving the gear set therein, and the fixing plate is fixed to the cap by a bolt extending through the fixing hole and threadedly engaging with the cap.

15. The motor-driven lock as claimed in claim 14, wherein the lock body further comprises a handle extending through the cap and attached to the controller, and a cutout is defined in the handle thereby exposing the gear portion of the controller.

16. The motor-driven lock as claimed in claim 3, wherein the first and seconds gearshafts each have a large portion and a small portion, the large portion of the first gearshaft mates with the motor, the small portion of the first gearshaft mates with the large portion of the second gearshaft, and the small portion of the second gearshaft mates with the wheel.

17. The motor-driven lock as claimed in claim 3, wherein the screw shaft comprises a head portion fixing the wheel thereat, a screwthread portion extending from the head portion and mating with the slider, and a pair of position pins extending generally from a junction of the head portion and the screwthread portion.

18. The motor-driven lock as claimed in claim 1, further comprising a lid attached to the housing over the transmission device, an enclosure attached on one side of the housing, and a cover attached on an opposite side of the housing.

19. The motor-driven lock as claimed in claim 18, wherein the housing further comprises a connector, and the enclosure defines a connecting port exposing the connector.

20. A motor-driven lock comprising:

a housing defining a central hole;

a lock body extending through the central hole of the housing and attached to the housing, the lock body comprising a controller, a cap attached to the controller and a handle extending through the cap and attached to the controller;

a motor received in the housing, the motor having a motor gear;

a transmission device received in the housing and mating with the motor gear of the motor and the lock body, the transmission device comprising a yoke and a gear set attached to the cap of the lock body, the yoke comprising a pair of leg portions and a pair of arm portions having a pair of guiding pins formed thereat respectively, the gear set mating with either of the leg portions of the yoke;

a lid attached to the housing over the transmission device, the lid defining a pair of splits receiving the guiding pins therein for guiding the movement of the yoke;

an enclosure attached over one side of the hosing; and a cover covering another side of the housing.

21. A motor-driven lock for optional use with two sides of a door, comprising:

a lock body including a rotatable controller with gears thereon;

a linearly moveable yoke including a pair of leg portions with racks thereon; and a gear set including more than one gears constantly engaged with the gears of the controller while selectively engaged with the corresponding rack on only one of said pair of leg portions so as to decide whether the controller is rotated clockwise or counterclockwise when said yoke is moved in a first direction; wherein said yoke includes resilient latches with thereon protrusions which engages a linearly moveable slider to move the yoke correspondingly while via resiliency thereof allowing said slider to be moveably located by two sides thereof mutually exclusively for movement of said yoke in two opposite directions.

22. The lock as claimed in claim 20, wherein said controller is located between said pair of leg portions.

23. The lock as claimed in claim 21, wherein said first direction is perpendicular to a rotation axis of said controller.

24. The lock as claimed in claim 21, wherein said lock body includes a handle extending from said rotation axis radially thus determining directionality thereof to meet the desired application on one side of said door.

25. The motor-driven lock as claimed in claim 20, wherein the transmission device further comprises a screw shaft and a slider mating with the screw shaft, and the yoke is linearly actuatable by the slider, and wherein the motor rotates the screw shaft, and the screw shaft actuates the slider such that the lock body is driven.

26. A motor-driven lock comprising:

a housing;

a lock body attached to the housing, the lock body comprising a controller having a gear portion;

a motor; and a transmission device mating with the motor and the gear portion of the lock body, the transmission device comprising a first gearshaft mating with the motor, a second gearshaft mating with the first gearshaft, a wheel mating with the second gearshaft, a screw shaft fixedly engaging with the wheel, a slider mating with the screw shaft, a yoke actuatable by the slider, and a gear set mating with the yoke and the gear portion of the lock body.

* * * * *